US011746795B2

(12) United States Patent
Iacoponi et al.

(10) Patent No.: US 11,746,795 B2
(45) Date of Patent: Sep. 5, 2023

(54) CENTRIFUGAL PUMP DEVICE

(71) Applicant: GRUNDFOS HOLDING A/S, Bjerringbro (DK)

(72) Inventors: Alessandro Iacoponi, Cascina (IT); Riccardo Dal Canto, Leghorn (IT)

(73) Assignee: GRUNDFOS HOLDING A/S, Bjerringbro (DK)

( * ) Notice: Subject to any disclaimer, the term of this patent is extended or adjusted under 35 U.S.C. 154(b) by 15 days.

(21) Appl. No.: 17/353,002

(22) Filed: Jun. 21, 2021

(65) Prior Publication Data

US 2021/0396240 A1 Dec. 23, 2021

(30) Foreign Application Priority Data

Jun. 22, 2020 (EP) ..... 20181335

(51) Int. Cl.

| | |
|---|---|
| ***F04D 27/00*** | (2006.01) |
| ***F04D 1/00*** | (2006.01) |
| ***F04D 29/22*** | (2006.01) |
| ***F04D 29/42*** | (2006.01) |
| ***F04D 9/02*** | (2006.01) |
| ***F04D 15/00*** | (2006.01) |
| ***F04D 1/06*** | (2006.01) |
| ***F04D 9/00*** | (2006.01) |

(52) U.S. Cl.

CPC ..... *F04D 27/008* (2013.01); *F04D 1/00* (2013.01); *F04D 1/06* (2013.01); *F04D 9/005* (2013.01); *F04D 9/02* (2013.01); *F04D 15/0005* (2013.01); *F04D 29/22* (2013.01); *F04D 29/426* (2013.01)

(58) Field of Classification Search

CPC ..... F04D 27/008; F04D 1/00; F04D 29/22; F04D 29/426; F04D 13/06; F04D 1/06; F04D 9/005; F04D 15/0005; F04D 15/0011; F04D 9/02; F04D 9/006

See application file for complete search history.

(56) References Cited

U.S. PATENT DOCUMENTS

| | | | | |
|---|---|---|---|---|
| 2,162,247 A | | 6/1939 | Dean et al. | |
| 5,718,564 A | * | 2/1998 | Nocchi | F04D 9/02 415/56.2 |
| 2014/0133960 A1 | * | 5/2014 | Tazioli | F04D 9/02 415/56.1 |

FOREIGN PATENT DOCUMENTS

| | | | | |
|---|---|---|---|---|
| EP | 1729009 A1 | | 12/2006 | |
| EP | 3293397 B1 | | 10/2018 | |
| KR | 101136846 B1 | * | 4/2012 | F04C 11/001 |
| WO | 9311360 A1 | | 6/1993 | |

* cited by examiner

*Primary Examiner* — Woody A Lee, Jr.
*Assistant Examiner* — Eric A Lange
(74) *Attorney, Agent, or Firm* — McGlew and Tuttle, P.C.

(57) ABSTRACT

A centrifugal pump device has at least one impeller (16), a circulation connection between a delivery side (22) of the at least one impeller (16) and a suction side (20) of the at least one impeller (16), and a valve arrangement (30, 46) in said circulation connection (44, 54). The valve arrangement (30, 46) has a first valve mode providing a pressure dependent shut-off valve (46) in the circulation connection. The valve arrangement (30, 46) allows a change between the first valve mode and at least one further valve mode. The at least one further valve mode provides at least one fixed closing degree of the circulation connection (44, 54).

19 Claims, 5 Drawing Sheets

CENTRIFUGAL PUMP DEVICE

CROSS REFERENCE TO RELATED APPLICATIONS

This application claims the benefit of priority under 35 U.S.C. § 119 of European Application 20181335.9, filed Jun. 22, 2020, the entire contents of which are incorporated herein by reference.

TECHNICAL FIELD

The invention refers to a centrifugal pump device and in particular to a centrifugal pump device in the form of a booster pump for water supply.

TECHNICAL BACKGROUND

EP 3 293 397 B1 discloses a centrifugal pump and a method for venting a centrifugal pump. This centrifugal pump comprises a back-flow or circulation connection between a delivery side of at least one impeller and the suction side. Inside this circulation connection there is arranged a pressure dependent shut-off valve closing the circulation connection when a predefined pressure is achieved on the delivery side of the pump.

SUMMARY

In view of this prior art it is the object of the present invention to improve a centrifugal pump device that can easily be adjusted to provide different venting functionalities.

This object is achieved by a centrifugal pump device having the features according to the invention. Preferred embodiments are defined in the following description as well as the accompanying drawings.

The centrifugal pump device according to the invention comprises at least one impeller. As known from common centrifugal pump devices this at least one impeller preferably is driven by an electric drive motor. The rotor of the electric drive motor may be connected to a shaft on which the at least one impeller is arranged. There is arranged a backflow or circulation connection between a delivery side of this at least one impeller and a suction side of the at least one impeller. This circulation connection allows to circulate liquid inside the pump for priming and venting the pump. The circulation preferably takes place until the entire pump is filed with liquid, in particular water, and the air is removed, for example by a suitable venting device inside the pump. Inside the circulation connection there is arranged a valve arrangement or valve device providing at least a first valve mode in which it provides the functionality of a pressure dependent shut-off valve in said circulation connection. Such pressure dependent shut-off valve is configured such that it can close said circulation connection if a certain pressure is achieved on the delivery side of the impeller. Usually, when the air is removed from the pump or substantially removed from the pump a desired pressure is achieved so that circulation of liquid inside the pump can be terminated to start the normal operation of the centrifugal pump.

According to the invention the valve arrangement is configured such that it allows to change between the described first valve mode and at least one further valve mode. The at least one further valve mode provides at least one fixed closing degree of the circulation connection. This means the at least one further valve mode provides a priming option or functionality different from the first valve mode in which the pressure dependent shut-off valve is in use. By changing the valve mode, the centrifugal pump device according to the invention can be adjusted to different requirements, in particular offering different priming functionalities or allowing to completely switch-off the priming functionality. Thereby the valve arrangement allows to use the same pump for different purposes or in different environments requiring different priming properties. This allows to reduce the need for several pumps designed for different purposes. Preferably the valve arrangement can be changed by a user or installer dependent on the respective need for a certain application. By this a centrifugal pump device useable for different purposes and adaptable to changes in the pump system can be provided.

According to a first possible embodiment of the invention the valve arrangement is configured such that in the at least one further valve mode the circulation connection is closed, in particular completely closed. This embodiment allows to switch-off the circulation and thereby to switch-off a priming functionality inside the centrifugal pump. Such a setting may be useful in applications where a venting is not required, i.e. where a dry running of the centrifugal pump does not occur. In such applications by switching-off the circulation the efficiency of the pump can be increased and/or noise can be reduced.

According to a further embodiment the valve arrangement may be configured such that in the at least one further valve mode the circulation connection has a fixed open cross section or a fixed minimum open cross section. A circulation connection with a fixed open cross section or a fixed minimum open cross section can provide an air-handling functionality according to which a continued minimal self-priming is maintained during the normal operation of the centrifugal pump. This can be achieved by a fixed open cross section of the circulation connection or a fixed minimum open cross section. If there is provided a fixed minimum open cross section this may be realized in combination with the shut-off valve so that in the first state the shut-off valve is fully open and then with increasing pressure closes until the minimum open cross section is reached. Then, during the following operation this minimum circulation cross section is maintained. In an alternative solution there may be provided a bypass channel bypassing the shut-off valve to maintain a minimum open cross section even if the shut-off valve is completely closed. Such air handling functionality may be advantageous for example in applications where the liquid to be pumped contains a lot of gas or air, since a repeating opening and closing of the shut-off valve causing noise can be avoided. The centrifugal pump having a valve arrangement providing such a further valve mode can easily be adjusted to such conditions without having the need to provide a special pump.

According to a further possible embodiment there may be provided two or more further valve modes providing a circulation connection having a fixed open cross section or a fixed minimum open cross section. In these two or more further valve modes there may be provided different fixed cross sections or different minimum open crossed sections of the circulation connection. By changing the valve mode, thus, the amount of circulation can be adjusted by changing between different possible fixed cross sections of the circulation channel or minimum open cross sections of a circulation channel. This allows to adjust the self-priming functionality or improved air handing functionality to different requirements.

According to a further preferred embodiment the valve arrangement is configured such that it provides a second valve mode in which the circulation connection is closed, in particular completely closed, and at least one third valve mode in which the circulation connection has a fixed open cross section or a fixed minimum open cross section. A centrifugal pump according to this embodiment offers to change the valve arrangement between three different valve modes to adapt the centrifugal pump to different applications. In a first valve mode the valve arrangement provides a circulation connection with a pressure dependent shut-off valve which closes the circulation connection when a certain outlet pressure is achieved. In the second valve mode the circulation connection is closed, i.e. the self-priming functionality is switched-off, for example for applications in which a high amount of air inside the pump cannot occur. In the third valve mode the circulation connection provides a fixed open cross section or a fixed minimum open cross section as described before. In this valve mode there is provided a continued minimal self-priming during the entire operation of the pump which is suitable for applications having a fluid with a higher amount of air or gas inside. In a further possible embodiment it may be possible to provide two or more third valve modes offering circulation connections providing fixed open cross sections of different size allowing to adjust the self-priming capabilities to different requirements by choosing a suitable cross section of the circulation connection.

According to a further embodiment of the invention the valve arrangement comprises a selector for changing the valve mode, preferably a selector provided for manually changing the valve mode. Such a selector allows a user or installer to choose the desired valve mode for a certain application. Preferably the selector is provided for manually changing, however, it may also be possible that the selector is connected to a drive means for automatically changing the valve mode by driving the selector. The drive means may be an electric motor or a hydraulic or magnetic motor or any other suitable drive. Such an embodiment would allow to change the valve mode during the operation, for example if a control device detects a change in the condition of the pumped fluid, for example dry running of the pump.

According to a further possible embodiment said valve arrangement comprises a single valve device providing the different valve modes and forming the shut-off valve in the first valve mode. For example in a second valve mode it is possible to block the shut-off valve by a suitable blocking means so that it is held in the closed position to shut-off the circulation connection. Furthermore, it would be possible to provide a minimum open degree of the shut-off valve by a suitable blocking means preventing a complete closing of the shut-off valve when the predefined outlet pressure is achieved. By such a configuration a minimum circulation connection during the entire operation of the pump can be maintained. The described blocking means may for example be brought into engagement with the shut-off valve by the described selector, preferably by manual actuation.

In an alternative solution of the present invention there may be provided a selector valve arranged in said circulation connection, the selector valve comprising a first port connected to a circulation channel comprising the shut-off valve and a movable, preferably rotatable, valve element which in the first valve mode opens the first port and in a second valve mode closes the first port. This means that the selector valve is arranged inside the circulation connection in series with the shut-off valve allowing to completely close the fluid connection via the shut-off valve to switch-off the self-priming functionality. This is achieved by a movable valve element which may close a respective port connected to the circulation channel inside which the shut-off valve is arranged. According to a preferred embodiment the valve element is rotatable. This allows a simple design of the selector valve and allows an easy actuation either by a drive means or manual actuation. Furthermore, a rotatable valve element allows a simple design of a selector valve having more than two valve or switching positions, as described in more detail below. Nevertheless, also different designs of the selector valves, for example with a linear movable valve element are possible.

The selector valve according to a further preferred embodiment comprises a second port connected to a bypass circulation channel bypassing the shut-off valve and providing a circulation connection having a fixed open cross section. In one valve mode the valve element of the selector valve opens this second port. Thus, in a first valve mode the valve element is positioned such that the first port is open towards the circulation channel comprising the shut-off valve. In this valve mode the circulation channel is open to allow a self-priming until a certain delivery pressure is achieved. Then, the shut-off valve closes to switch-off the fluid connection through the circulation channel. In a second valve mode alternatively or in addition the second port may be opened towards a bypass channel having a fixed open cross section. In this position a continued circulation during the entire operation of the pump is maintained to continue a minimal self-priming, as described above.

Preferably the movable valve element has three different valve or switching positions corresponding to three different valve modes of the valve arrangement in the circulation connection. The selector valve preferably is configured such that the movable valve element in the first valve mode opens the first port and closes the second port. In this position the circulation channel comprising the shut-off valve is open and the bypass channel as described before is closed. In a second valve mode the movable valve element preferably closes the first and the second port, i.e. the circulation channel comprising the shut-off valve and the bypass channel are closed. In this valve mode the self-priming functionality is completely switched-off.

Furthermore, in a third possible valve position corresponding to the third vale mode the valve element opens the first and the second port. In this position self-priming via the circulation channel containing the shut-off valve is allowed until a predefined delivery pressure is achieved so that the shut-off valve closes and the fluid connection through the circulation channel is closed. Since in this valve mode also the bypass channel is opened there is maintained a reduced circulation with a continued minimal self-priming during the further normal operation of the pump.

Preferably the described bypass channel has a cross section which is smaller than the maximum cross section of a circulation channel containing the shut-off valve with the shut-off valve in the open condition. Thus, the bypass channel can offer a reduced self-priming with a reduced circulation when the shut-off valve is closed. The cross section of the bypass channel may be a compromise of the pump performance and the required self-priming or air handling. The size is dependent on the specific pump.

The shut-off valve preferably is configured as a check valve being spring loaded. The spring load in such configuration defines the predefined delivery pressure at which the shut-off valve closes. Thus, the shut-off valve is actuated by the delivery pressure produced by the pump. Different biasing solutions can be used to provide a necessary preload to keep the shut-off valve open until a predefined pressure is reached. Furthermore, it would be possible to provide a pressure sensor to detect the delivery pressure and to close the shut-off valve by a control device receiving the sensor signal. In such a solution for example a solenoid or another suitable drive means for closing the shut-off valve may be used.

According to a further preferred embodiment of the invention the selector valve comprises an outlet port connected to the suction side of the at least one impeller and the valve element is configured such that in the first valve position or valve mode it provides a fluid connection between the first port and this outlet port, and in a third valve mode preferably it provides a fluid connection between the first and the second port on one side and the described outlet port on the other side. This means in a first valve mode there is a circulation connection via the fluid channel containing the shut-off valve through the first port towards the outlet port and in the third valve position there is a circulation connection through the second and first port and, therefore, through the circulation channel containing the shut-off valve and through the described bypass channel in parallel.

Preferably, said movable valve element of the selector valve has at least three selectable valve positions defining the three different valve modes as described before. The valve element is a rotatable valve element. These three different valve or switching positions are three different angular positions about the rotational axis of the rotatable valve element.

Furthermore, the selector valve may comprise an actuating element which is provided to switch the valve element between the different valve positions defining the valve modes. The actuating element may be configured to manually move or shift the valve element. For example, the actuating element may have a grip portion and/or a tool engagement portion which may be used to grip and move the valve element or to engage a tool to manually move the valve element. As described above in an alternative solution the actuating element may be a drive means allowing to move the valve element in response to a signal from a suitable control device setting the valve position.

According to a special embodiment of the invention the actuating element may be covered by a removeable cover element, preferably a removable housing portion of the centrifugal pump device. The removable cover element can be removed during installation or maintenance of the pump device. In this condition the actuating element can be used to bring the valve element into the desired valve position. When the installation is completed the cover can be closed or attached to the centrifugal pump device so that the actuation element is covered and a change of the valve position by mistake can be prevented. Furthermore, the further design of the centrifugal pump can be independent from the actuating element.

As already described above the selector valve may comprise a rotatable valve element which is rotatable between the different valve positions. Preferably said valve element comprises a valve wall extending concentrically about a rotational axis of the valve element.

This valve wall may be configured such that it interacts with at least one opposing valve opening, the valve opening forming a port as described before. Preferably, the valve wall circles a free space, wherein this free space preferably is in fluid connection with the suction side of the impeller, i.e. may be in connection with an outlet port of the selector valve. The valve wall may move in parallel to a surrounding inner circumferential wall of a valve receiving opening inside which the valve element is arranged and rotatable. Preferably the valve wall may slide along this inner circumferential wall and close the respective openings or ports as described above by overlapping these openings in a respective valve position.

The pump device as described above may be configured as a multistage pump having two or more impellers arranged in series. In such a multistage pump said circulation connection preferably connects the delivery side of one impeller or a group of impellers with the suction side of the first impeller seen in flow direction through the pump device. Preferably the circulation connection connects the delivery side of a first impeller or a first group of impellers in flow direction with the suction side of the first impeller. The self-priming may be achieved by a circulation through a first impeller or first group of impellers, whereas the following impellers are not used for the self-priming. The allows to speed up the self-priming. However, according to a further possible embodiment the circulation connection may connect the delivery side of the last impeller of the entire pump with the inlet of the first impeller.

The centrifugal pump as described preferably is configured for use as a booster pump for domestic water supply. Thus, also a booster pump for domestic water supply having the features as disclosed above is subject of the present invention. Those booster pumps may be used in a domestic water supply where the supply pressure of the water is not sufficient.

In the following the invention is described by way of example with reference to the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
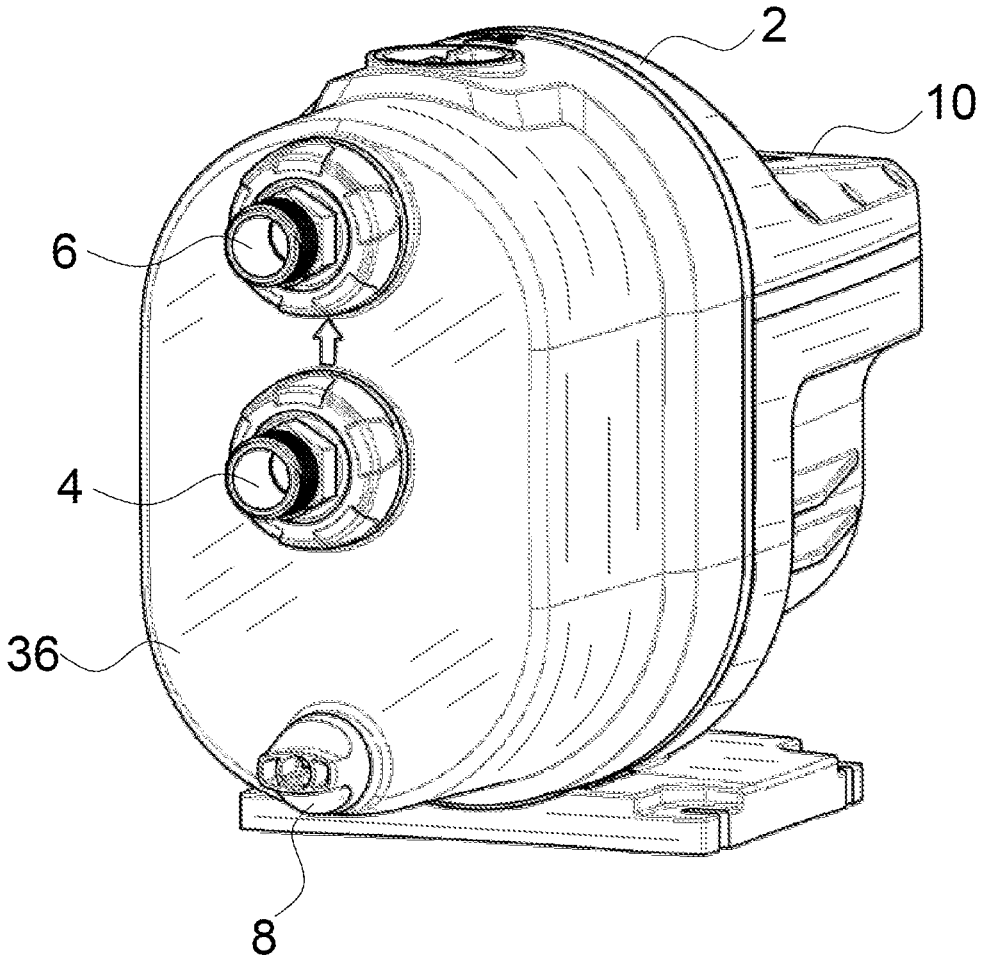
FIG. 1 is a perspective view showing a centrifugal pump device according to the invention.
Figure 2:
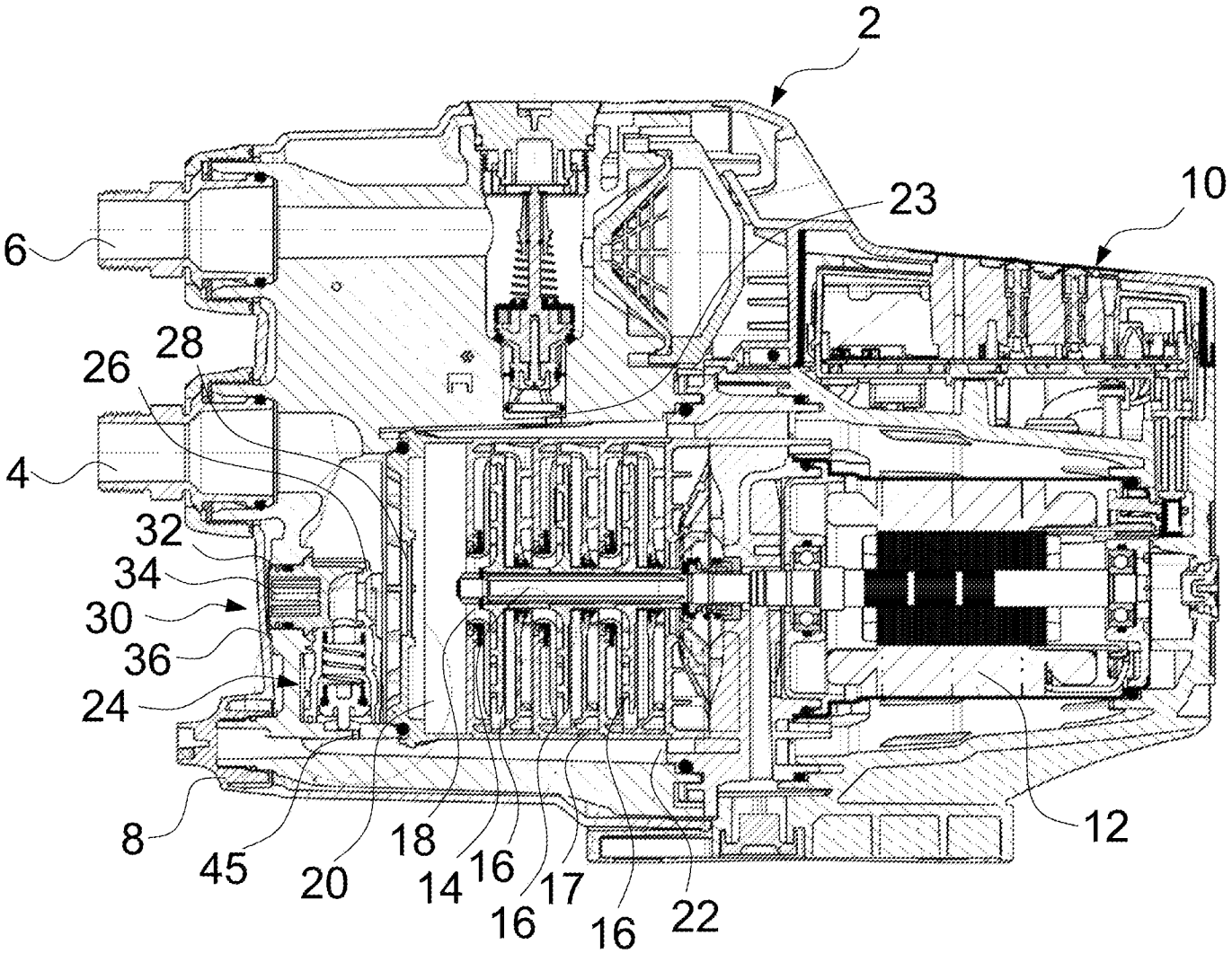
FIG. 2 is a cross sectional view of the centrifugal pump device according to FIG. 1.
Figure 3:
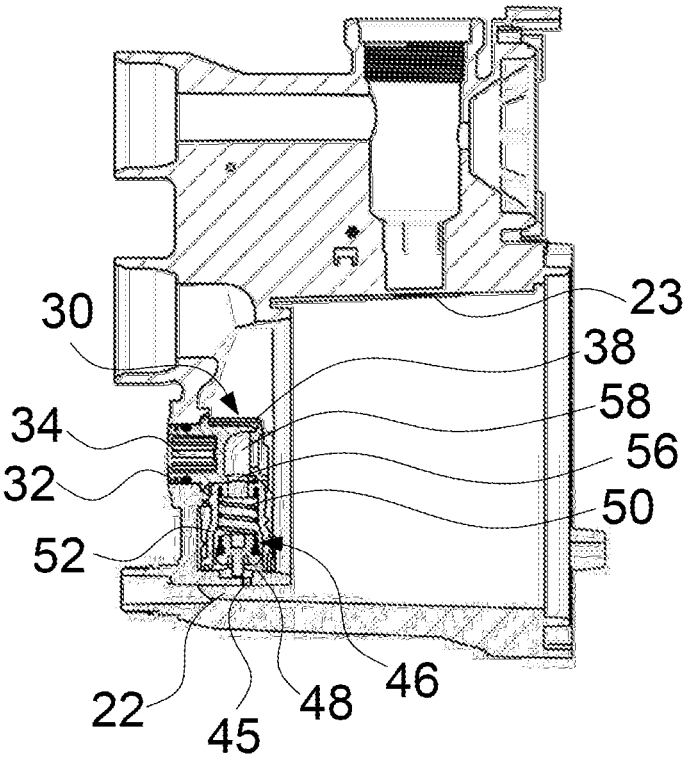
FIG. 3 is an enlarged cross sectional view of the valve arrangement of a circulation connection.

Referring to the drawings, a centrifugal pump device as shown is a booster pump for domestic water supply and is built as an integrated unit integrating a pump and an electric drive motor in a surrounding housing 2. On the housing 2 there is arranged an inlet connection 4 and an outlet connection 6 for connection with a piping inside a building. Near the bottom there is provided a drain screw 8 which can be opened for draining the interior of the pump. On top of the housing 10 there is arranged a control panel 10.

Inside the housing 2 there is arranged an electric drive motor 12 connected to a drive shaft 14 which is connected to three impellers 16 arranged in series. Thus, in this example the centrifugal pump is a multistage pump having three stages. Between the impellers there are arranged diffusers 17 as usual for those multistage pumps. The inlet 18 of the first impeller is open towards a suction space 20 which is connected with the inlet connection 4. The outlet of the third impeller is open towards an outlet channel 22 surrounding the diffuser arrangement. The outlet channel 22 is connected to the outlet connection 6 via the opening 23.

The shown centrifugal pump comprises a self-priming means 24 shown in more detail in FIGS. 3 to 7.

The self-priming means 24 comprises a circulation connection having an outlet port 26 which is open towards a suction space 20 via the entrance opening 28 of the suction space 20. The outlet port 26 is the outlet port of a selector valve 30 of a valve arrangement in said self-priming means 24. The selector valve 30 comprises a rotatable valve element 32. The valve element 32 has tool engagement portion 34 into which a tool for rotating the valve element can be inserted. The tool engagement portion 34 is covered by a housing portion 36 forming a part of the housing 2. Therefore, before setting the selector valve by moving the rotatable valve element 32 the housing portion 36 has to be removed. After setting the selector valve the housing portion 36 can be attached and the tool engagement portion 24 cannot be seen or engaged from the outside anymore. Thus, in this embodiment the housing portion 36 forms a cover element covering the selector valve. By this a change of the valve position during operation can be prevented.

The valve element 32 is arranged in a circular receiving space 38 having a circumferential wall with a first opening or port 40 and a second opening or port 42. The first port 40 is open towards a circulation channel 44 connected to the outlet channel 22 via passage 45. In the circulation channel 44 there is arranged a shut-off valve 46. The shut-off valve 46 comprises a movable valve element 48 biased by a spring 50. With increasing pressure in the circulation channel the valve element 48 is moved against the biasing force of the spring 50 until the valve element 58 abuts against the valve seat 52 and closes the circulation channel 42.

The second port 42 is open towards a bypass channel 54. On the opposite side the bypass channel 54 is also open towards the outlet channel 22 via passage 45. Thus, the bypass channel 54 forms a circulation connection in parallel to the circulation channel 44. The bypass channel 54 does not comprise a valve assembly and provides a fixed cross section.

Figure 7:
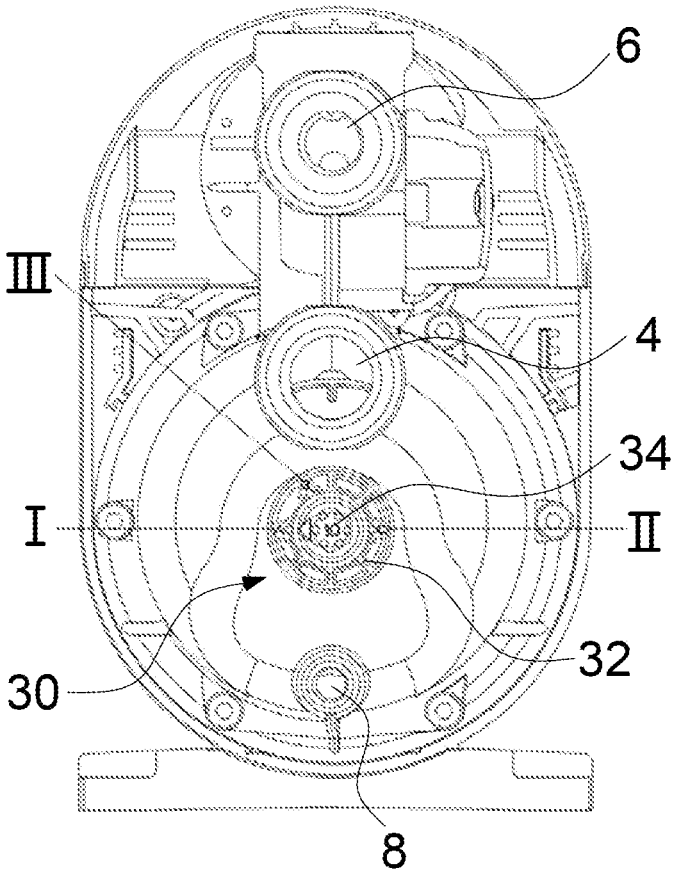
FIG. 7 is a front view of the centrifugal pump device with removed cover element.

The valve element 32 of the selector valve 30 has two openings 56 inside the cylindrical valve wall. The valve wall with the two openings 56 encircles a free space 58 inside the valve element 32, which free space 58 is connected to the outlet port 26. The openings 56 are arranged such that by rotating the valve element 32 they can be brought into a position aligned with the ports 40 and 42. The selector valve has three possible valve positions or valve modes which may be defined for example by detents engaging the valve element 32. The three different valve modes are defined by three different valve position I, II and III in different angular positions about the rotational axis of the valve element 32 as best shown in FIG. 7. The first valve position I corresponds to a valve mode providing self-priming of the pump. The second valve position II offers a second valve mode not offering any self-priming. The third valve position III in an angular position between the first and second valve position corresponds to a third valve mode offering improved air handling as described in more detail below.

Figure 4:
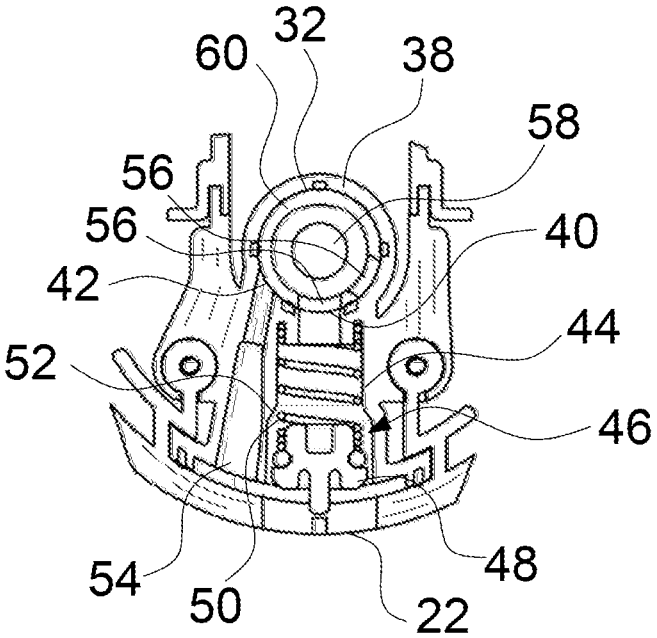
FIG. 4 is a detail view of a selector valve in a first valve mode.

FIG. 4 shows the first valve mode or valve position in which one of the openings 56 is aligned with the first port 40, whereas the valve wall 60 closes the second port 42. In this valve position the free space 58 is connected to the circulation channel 44 via one opening 56 and the first port 40. In this valve position the pump offers a self-priming functionality. The spring 50 keeps the shut-off valve open until a predefined outlet pressure on the delivery side, i.e. inside the outlet channel 22 is achieved. Then, by this pressure the valve element 48 is forced against the valve seat 54 and the circulation channel 44 is closed for the following further operation of the pump.

Figure 5:
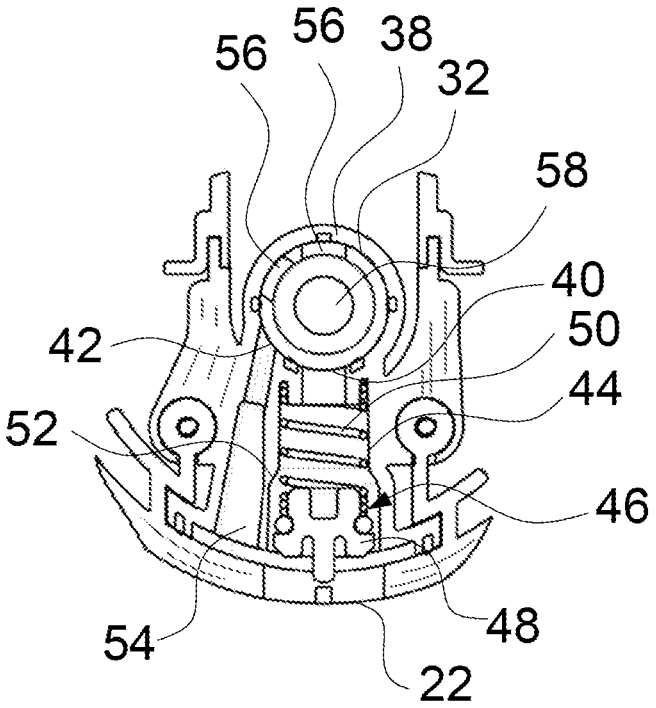
FIG. 5 is a detail view of the selector valve according to FIG. 4 in a second valve mode.

FIG. 5 shows the second valve mode of the valve arrangement consisting of the selector valve 30 and the shut-off valve 46. In this second valve mode the valve element 32 is rotated such that both the first port 40 and the second port 42 are covered by the valve wall 60 and, thus, the circulation channel 44 and the bypass channel 54 are closed. In this second valve mode the self-priming functionality is switched-off, i.e. the circulation connection is completely closed. This mode may be used in applications where no self-priming functionality is necessary, since for example a dry running of the pump is not expected.

Figure 6:
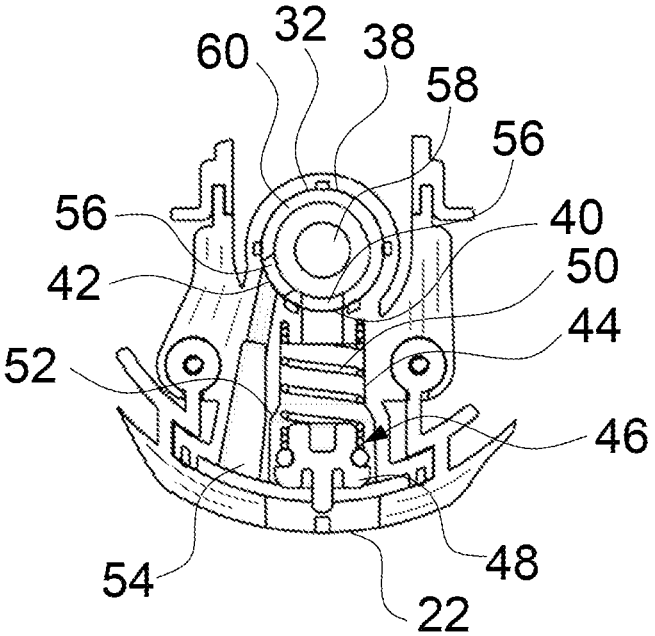
FIG. 6 is a detail view of the selector valve according to FIGS. 4 and 5 in a third valve mode.

FIG. 6 shows the third valve mode providing an improved air handling. In this valve mode the valve element 32 is in its third valve position in which the two openings 56 are aligned with the first port 40 and the second port 42 so that the first and the second ports are opened towards the free space 58 and further to the inlet side of the first impeller. Thus, both the circulation channel 44 and the bypass channel 54 together form a circulation connection between the delivery side, i.e. the outlet channel 22 and the suction space 20. In this configuration the circulation channel 44 is open as long as a predefined pressure in the outlet channel 22 is not reached. If the pressure defined by the load of the spring 50 is reached the biasing force of the spring 50 is overcome and the valve element 48 is pressed against the valve seat 52. Thus, the circulation channel 44 is closed. The bypass channel 54, however, which does not comprise any valve element is kept open and ensures a continued minimal self-priming during the further operation of the pump. This third valve mode is suitable in applications having a greater amount of air or gas in the water to be pumped. The continued minimal self-priming avoids an alternating opening and closing of the valve element 48. This can reduce the noise occurring from opening and closing the shut-off valve 46 and can improve the operation of the pump.

While specific embodiments of the invention have been shown and described in detail to illustrate the application of the principles of the invention, it will be understood that the invention may be embodied otherwise without departing from such principles.

REFERENCES

2 housing
4 inlet connection
6 outlet connection
8 drain screw
10 control panel
12 electric drive motor
14 drive shaft
16 impeller
17 diffusers

18 inlet
20 suction space
22 outlet/delivery channel
23 opening
24 self-priming means
26 outlet port
28 entrance opening
30 selector valve
32 valve element
34 tool engagement portion
36 housing portion, cover element
38 receiving space
40 first port
42 second port
44 circulation channel
45 passage
46 shut-off valve
48 valve element
50 spring
52 valve seat
54 bypass channel
56 openings
58 free space
60 valve wall
I, II, III valve positions

What is claimed is:

1. A centrifugal pump device comprising:

at least one impeller;

a circulation connection between a delivery side of the at least one impeller and a suction side of the at least one impeller; and a valve arrangement in said circulation connection, the valve arrangement having a first valve mode providing a pressure dependent shut-off valve in said circulation connection, and at least one further valve mode providing at least one fixed closing degree of the circulation connection, wherein said valve arrangement allows a change between the first valve mode and the at least one further valve mode, and wherein the valve arrangement comprises a selector configured to change the valve arrangement between the first valve mode and the at least one further valve mode said valve arrangement comprising a selector valve arranged in said circulation connection, wherein the selector valve comprises a first port that is connected to a circulation channel of said circulation connection and the selector valve comprises a pressure dependent shut-off valve in said circulation connection and the selector valve comprises a movable valve element configured to open the first port in the first valve mode and close the first port in the at least one further valve mode.

2. The centrifugal pump device according to claim 1, wherein in the at least one further valve mode the circulation connection is closed.

3. The centrifugal pump device according to claim 1, wherein in the at least one further valve mode the circulation connection has a fixed open cross section or a fixed minimum open cross section.

4. The centrifugal pump device according to claim 1, wherein the at least one further valve mode comprises a second valve mode in which the circulation connection is closed and a third valve mode in which the circulation connection has a fixed open cross section or a fixed minimum open cross section.

5. The centrifugal pump device according to claim 1, wherein the selector is configured for manually changing the valve mode.

6. The centrifugal pump device according to claim 1, wherein said valve arrangement comprises a single valve device providing the different valve modes and forming the shut-off valve in the first valve mode.

7. The centrifugal pump device according to claim 1, wherein: the selector valve comprises a second port connected to a bypass circulation channel bypassing the pressure dependent shut-off valve and providing a circulation connection having a fixed open cross section; and in one of the first valve mode and the at least one further valve mode the movable valve element of the selector valve opens the second port.

8. The centrifugal pump device according to claim 7, wherein:

the further valve mode comprises a second valve mode in which the circulation connection is closed and a third valve mode;

the movable valve element in the first valve mode opens the first port and closes the second port;

the movable valve element in the second valve mode closes the first port and the second port; and the movable valve element in the third valve mode opens the first port and the second port.

9. The centrifugal pump device according to claim 7, wherein the selector valve comprises an outlet port connected to the suction side of the at least one impeller and wherein the valve element in the first valve mode provides a fluid connection between the first port and the outlet port, and in the further valve mode provides a fluid connection between the first port and the second port and the outlet port.

10. The centrifugal pump device according to claim 8, wherein said movable valve element of the selector valve has at least three selectable valve positions defining three different valve modes.

11. The centrifugal pump device according to claim 1, wherein: the movable valve element of the selector valve comprises a rotatable valve element, which is rotatable between different valve positions corresponding to the first valve mode and at least one further valve mode; and the selector valve comprises a valve wall extending concentrically about a rotational axis of the rotatable valve element and interacting with at least one opposing valve opening, and the valve wall encircles a free space in fluid connection with the suction side of the impeller.

12. The centrifugal pump device according to claim 1, further comprising at least another impeller to provide two or more impellers, wherein:

the pump device is a multistage pump having the two or more impellers arranged in series; and said circulation connection connects the delivery side of one impeller or a group of impellers with the suction side of the first impeller with respect to a flow direction through the centrifugal pump device.

13. The centrifugal pump device according to claim 1, wherein the centrifugal pump device is configured for use as booster pump for domestic water supply.

14. A centrifugal pump device, comprising:

at least one impeller;

a circulation connection between a delivery side of the at least one impeller and a suction side of the at least one impeller; and a valve arrangement in said circulation connection, the valve arrangement having a first valve mode providing a pressure dependent shut-off valve in said circulation connection, and at least one further valve mode providing at least one fixed closing degree of the circulation connection, wherein said valve arrangement allows a change between the first valve mode and the at least one further valve mode, and wherein the valve arrangement comprises a selector configured to change the valve arrangement between the first valve mode and the at least one further valve mode said valve arrangement comprising a selector valve arranged in said circulation connection, wherein the selector valve comprises a first port that is connected to a circulation channel of said circulation connection and the selector valve comprises a pressure dependent shut-off valve in said circulation connection and the selector valve comprises a movable valve element configured to open the first port in the first valve mode and close the first port in the at least one further valve mode, wherein the selector valve comprises an actuating element configured to switch the valve element between the different valve positions defining the valve modes.

15. The centrifugal pump device according to claim 14, wherein the actuating element is configured to manually change the valve position, wherein the actuating element comprises a grip portion or a tool engagement portion or both a grip portion and a tool engagement portion.

16. The centrifugal pump device according to claim 14, further comprising removable cover element, wherein the actuating element is covered by the removable cover element.

17. A centrifugal pump device comprising:

an impeller;

a circulation connection between a delivery side of the impeller and a suction side of the impeller; and a valve arrangement in said circulation connection, the valve arrangement having a first valve mode providing a pressure dependent circulation connection shut-off and at least one further valve mode providing at least one circulation connection fixed closing degree, wherein said valve arrangement is configured to change between the first valve mode and the at least one further valve mode, said valve arrangement comprising a selector valve arranged in said circulation connection, wherein the selector valve comprises a first port that is connected to a circulation channel of said circulation connection and the selector valve comprises a pressure dependent shut-off valve in said circulation connection and the selector valve comprises a movable valve element configured to open the first port in the first valve mode and close the first port in the at least one further valve mode.

18. The centrifugal pump device according to claim 17, wherein:

a second port is connected to a bypass circulation channel of said circulation connection, which bypasses the pressure dependent shut-off valve, and which provides the at least one fixed closing degree of the circulation connection having a fixed open cross section; and in one of the first valve mode and the at least one further valve mode the movable valve element of the selector valve opens the second port.

19. The centrifugal pump device according to claim 17, wherein the at least one further valve mode comprises a second valve mode in which the circulation connection is closed and a third valve mode in which the circulation connection has a fixed open cross section or a fixed minimum open cross section.

* * * * *